US006132245A

United States Patent [19]

Wertz et al.

[11] Patent Number: 6,132,245

[45] Date of Patent: Oct. 17, 2000

[54] ELECTRICAL CONNECTOR FOR A SPEAKER CABINET

[75] Inventors: Darrell Lynn Wertz, York; Robert Stewart Correll, Jr., Harrisburg, both of Pa.

[73] Assignee: The Whitaker Corporation, Wilmington, Del.

[21] Appl. No.: 09/071,949

[22] Filed: May 4, 1998

[51] Int. Cl.[7] ..... H01R 13/73

[52] U.S. Cl. ..... 439/556; 439/441; 439/268

[58] Field of Search ..... 439/556, 548, 439/559, 837, 271, 272, 273, 274, 275, 276, 277, 188, 189, 783, 821, 820, 819, 441, 439, 440, 268, 835, 857; 381/393, 394

[56] References Cited

U.S. PATENT DOCUMENTS

| | | | |
|---|---|---|---|
| 4,636,026 | 1/1987 | Cooney et al. | 339/255 R |
| 4,645,278 | 2/1987 | Yevak, Jr. et al. | 339/17 T |
| 4,703,508 | 10/1987 | Umezu | 381/188 |
| 4,978,315 | 12/1990 | Edgley et al. | 439/441 |
| 5,047,114 | 9/1991 | Frisch et al. | 156/630 |
| 5,106,328 | 4/1992 | Prochaska et al. | 439/751 |
| 5,348,686 | 9/1994 | Vyas | 252/514 |
| 5,385,490 | 1/1995 | Demeter et al. | 439/579 |
| 5,410,257 | 4/1995 | Swaffield | 324/755 |
| 5,501,609 | 3/1996 | Watanabe | 439/277 |
| 5,511,990 | 4/1996 | Klemen | 439/559 |
| 5,562,292 | 10/1996 | Roy et al. | 277/12 |
| 5,685,735 | 11/1997 | Hohorst | 439/441 |
| 5,856,908 | 1/1999 | Takiguchi et al. | 361/690 |
| 5,895,286 | 4/1999 | Linke | 439/441 |
| 5,921,782 | 7/1999 | Yamaguchi et al. | 439/34 |
| 6,007,369 | 12/1999 | Kennedy et al. | 439/441 |

*Primary Examiner*—Paula Bradley
*Assistant Examiner*—Ross Gushi

[57] ABSTRACT

An electrical connector (16) is adapted to be secured to a mounting surface (84) of an electrical component (12). A gasket (86) is disposed between the connector and the mounting surface to provide an acoustical seal and to urge the connector outwardly against its latching members (72, 76) to provide a firm and stable assembly (10). The connector (16) includes a button (38) which, when depressed, operates contacts (52,54) for receiving a conductor (22,24). Spaced apart projections (100) extend from a surface (88) of the connector into pressing engagement with portions (106) of the gasket thereby having a stabilizing affect on the connector when the button is depressed.

8 Claims, 4 Drawing Sheets

ELECTRICAL CONNECTOR FOR A SPEAKER CABINET

The present invention relates to an electrical connector for releasably connecting conductors to leads of an electrical component, such as an acoustical speaker, and more particularly to such a connector that is secured to the cabinet of the component and seated against a deformable gasket.

BACKGROUND OF THE INVENTION

Remote acoustical speakers used with various audio systems are typically interconnected with their audio system by means of multiple conductors. Each of the conductors is releasably received in a connector that is attached to one of the speakers. These connectors usually include openings through which one or more of the conductors are inserted and a button or lever that is depressed to move contacts within the opening to one side so that the conductors can be fully inserted. When the button or lever is released, a spring urges the contacts together so that each conductor is pressed between its respective contacts to make the desired electrical connections. The connector is usually secured to an outer surface of the speaker cabinet so that lead portions of the electrical contacts extend into the interior of the cabinet, where they are interconnected to the speaker by means of conductors in the usual manner. In such applications the acoustical integrity of the speaker cabinet must be maintained by sealing the interface between the connector housing and the cabinet. This is accomplished by placing a compressible gasket between the mounting surfaces of the connector and the cabinet. However, when the button is depressed to insert the conductors, the connector has a tendency to rock from side to side and to fully compress the gasket. After a period of time in use, the gasket looses its resiliency because it becomes crushed and then forms a poor seal and allows the connector to become loose and easily move out of alignment with the cabinet resulting in poor aesthetic appearance.

What is needed is a connector that lends itself to aesthetic integration into the cabinet of an electrical component. Further, the connector should not over compress the sealing gasket so that the gasket becomes crushed and looses its resiliency.

SUMMARY OF THE INVENTION

An electrical connector is arranged to be secured to a first mounting surface of an electrical component. The connector releasably receives a conductor and electrically interconnects the conductor to the component. The connector includes an insulating housing having a second mounting surface, an electrical contact in the housing interconnected to the component and operable to receive the conductor, and a button in sliding engagement with the housing arranged so that when depressed in a first direction toward the second mounting surface the contact operates to receive the conductor. A gasket is disposed in engagement with the second mounting surface, and adapted to engage the first mounting surface so that it is disposed between the first and second mounting surfaces when the connector is secured to the component. A spaced apart plurality of projections extend from the second surface into pressing engagement with portions of the gasket thereby stabilizing the electrical connector when secured to the first mounting surface and the button is depressed in the first direction.

An embodiment of the invention will now be described by way of example with reference to the following drawings.

DESCRIPTION OF AN EMBODIMENT OF THE INVENTION

Figure 1:
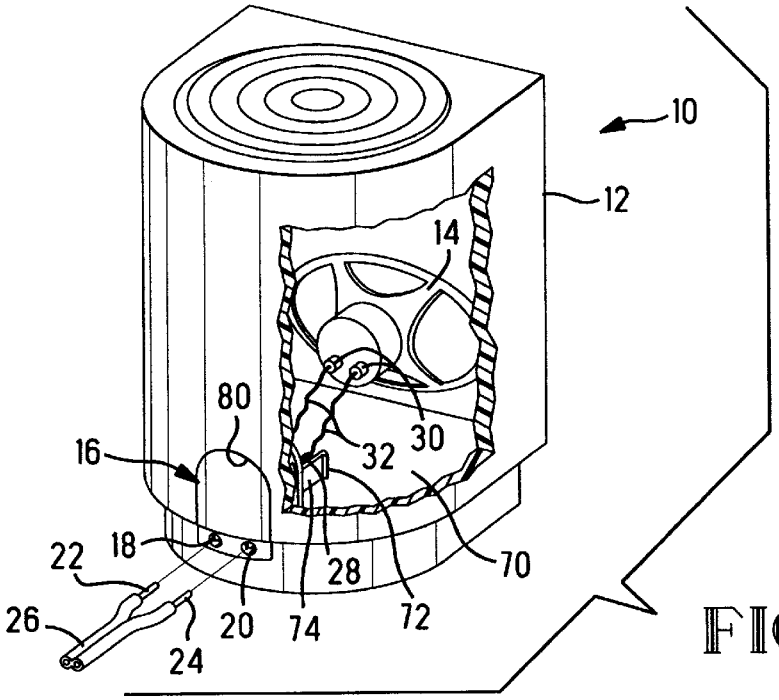
FIG. 1 is an isometric view of a speaker enclosure having a partial cutaway, incorporating the teachings of the present invention.
Figure 2:
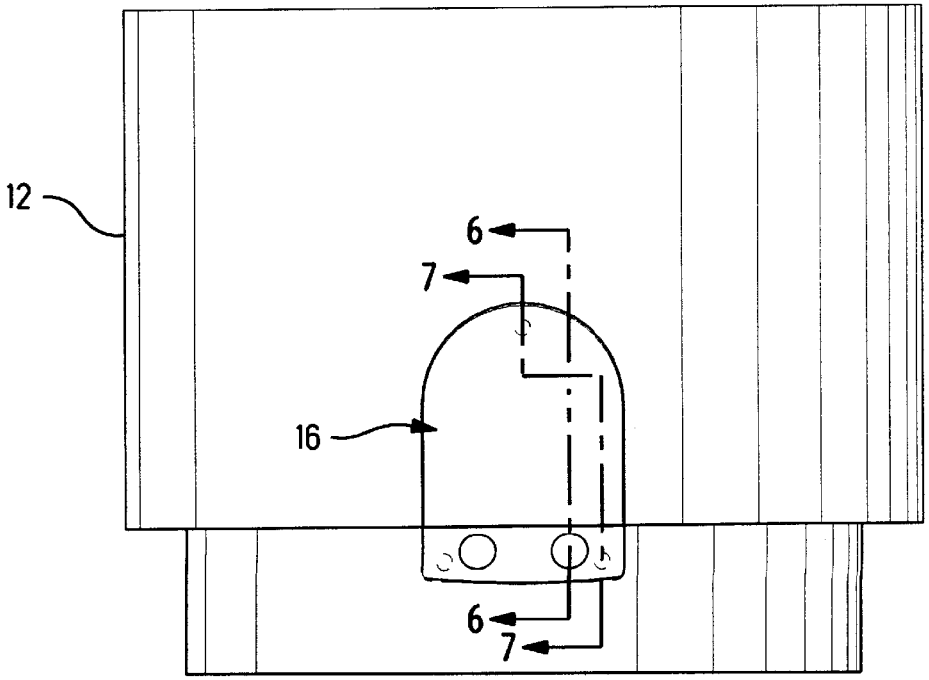
FIG. 2 is a rear view of the speaker enclosure showing the connector of the present invention.

There is shown in FIG. 1 a speaker enclosure 10 having a curved outer housing 12 containing an acoustical speaker 14. An electrical connector 16 is arranged within an opening in the housing 12 and includes a pair of wire receiving openings 18 and 20 for receiving a pair of conductors 22 and 24 of a cable 26, one conductor in each respective opening. The connector 16 includes a pair of contact posts 28 which are interconnected to terminals 30 on the speaker 14 by means of wires 32, in the usual manner, for interconnecting each conductor 22, 24 to a respective one of the terminals 30.

Figure 3:
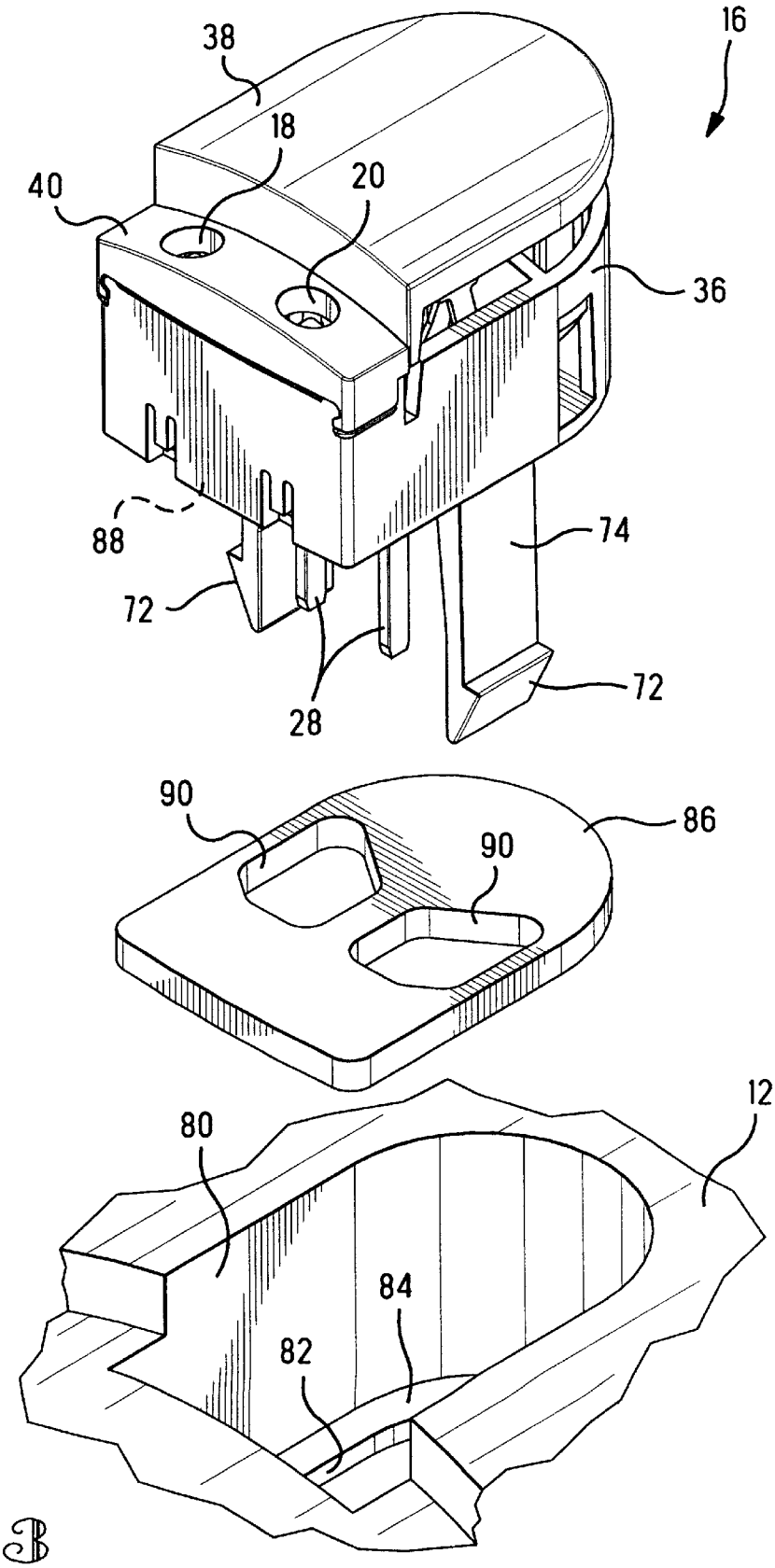
FIG. 3 is a partial exploded parts view of the connector shown in FIG. 2, including a gasket and a portion of the speaker enclosure.
Figure 4:
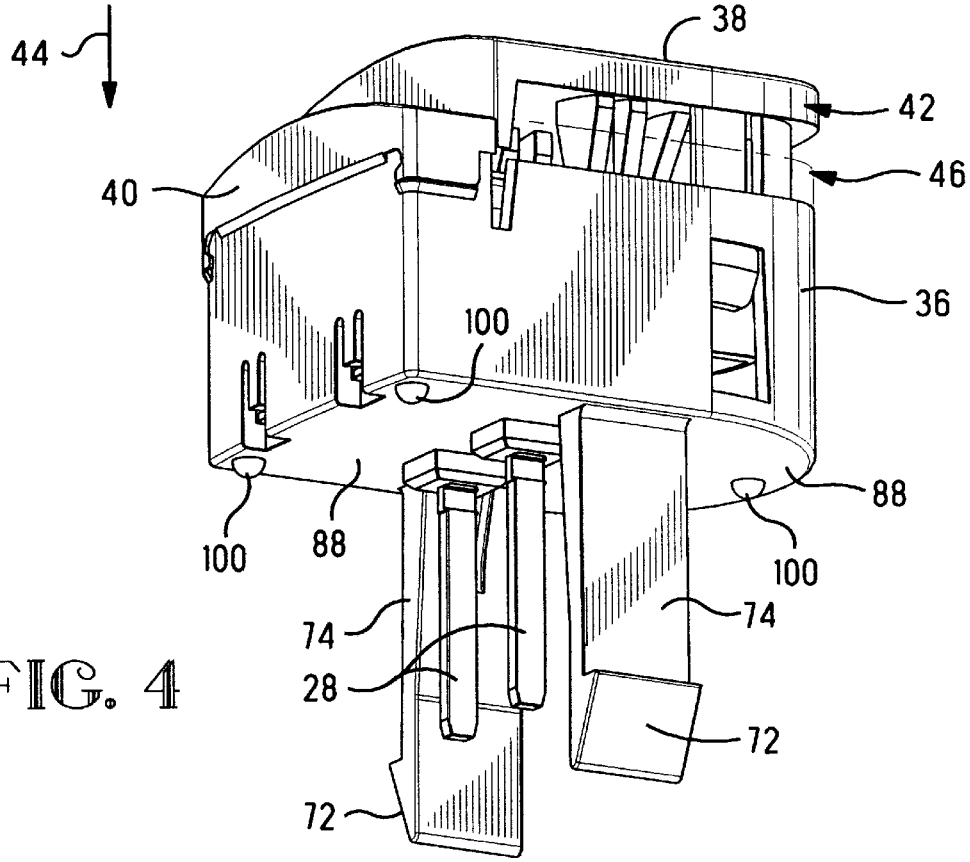
FIG. 4, is an isometric view of the connector shown in FIG. 2, as viewed from the lower side.

The connector 16, as best seen in FIG. 3, includes an insulating housing 36, a depressable push button 38, and a wire guide cap 40. The push button 38 can be depressed from a first position 42, shown in solid lines in FIG. 4, in the direction of the arrow 44 to a second position 46 shown in phantom lines. When pressure is released, the push button is returned to its first position 42, by means of a resilient member 43 within the connector 16. The housing 36 includes two side by side cavities 48 and 50, each of which snugly receives a respective one of first and second contact members 52 and 54 against a floor 56 of the cavities.

Figure 6:
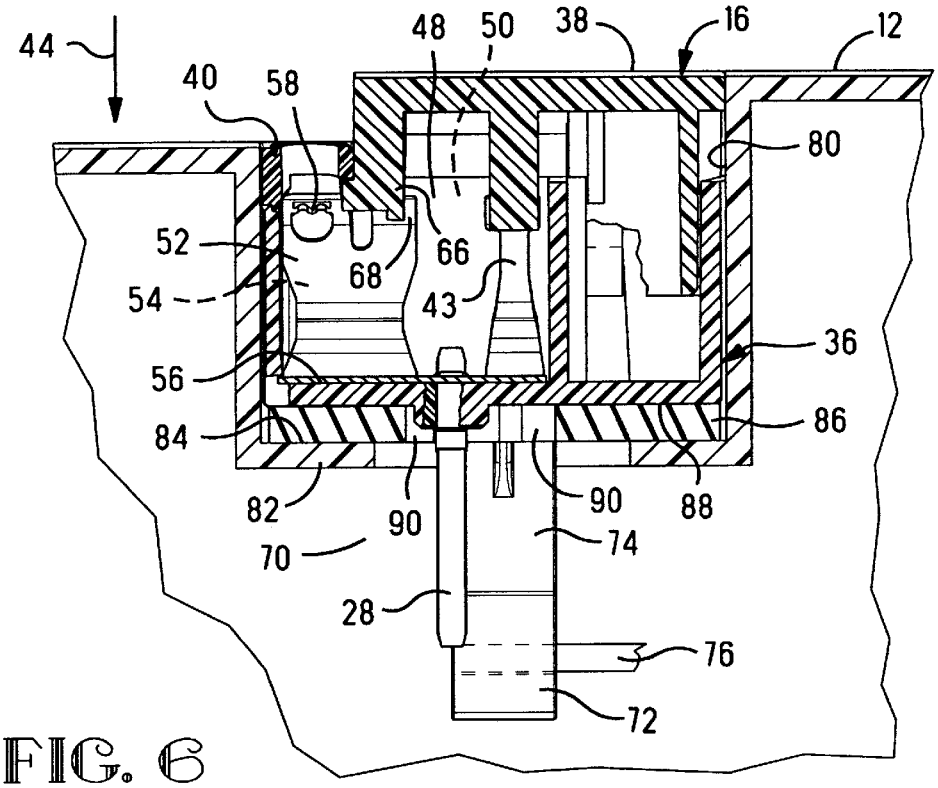
FIGS. 6 and 7 are cross-sectional views taken along the lines 6—6 and 7—7, respectively, in FIG. 2

Each contact 52, 54 includes a gripping portion 58 that is positioned directly under and in alignment with a respective opening 18 and 20 for receiving and tightly gripping one of the conductors 22, 24. When the button 38 is depressed to the second position 46, wedges 66 formed integral to the button engage camming surfaces 68 of the contact members thereby causing the gripping portions 58 to open for receiving the conductors. When the button 38 is released, it moves upwardly toward its first position until the gripping portions engage and tightly grip their respective conductors. Each of the contact posts 28 is electrically attached to a respective one contact member and extends downwardly through the floor 56 of the housing 36 and into the interior 70 of the speaker enclosure 10, as shown in FIGS. 1 and 6. A pair of latching members 72 are formed on the ends of resilient arms 74 that extend downwardly from the housing 36 and latchingly engage keeper surfaces 76 which are attached to the enclosure 10 within the interior 70.

The connector 16 is snugly received within a cavity 80 formed in the speaker enclosure 10 so that the outer surfaces of the push button 38 and wire guide cap 40 are flush with the outer surfaces of the speaker enclosure. The purpose of this is to enhance the aesthetic appeal of the final product. A flange 82 extends entirely around the cavity, as best seen in FIGS. 3 and 6, thereby forming a floor 84 against which the connector 16 is seated. A resilient gasket 86 is positioned between the flange 82 and the bottom surface 88 of the housing 36, as shown in FIG. 6. The gasket 86 includes a pair of clearance openings 90 so that the contact posts 28 and the resilient arms 74 can extend therethrough and into the interior 70. The length of the arms 74 and the positions of the keeper surfaces 76 are chosen so that the gasket is compressed to about one half its free form thickness. The gasket, in the present example, has a free form thickness of about 0.080 inch and a working compressed thickness of about 0.040 inch. The purpose of the gasket 86 is to provide an acoustical seal between the connector 16 and the outer housing 12, and to urge the connector housing 36 upwardly so that the latching members 72 are held firmly in engagement with the keeper surfaces 76. This keeps the outer surfaces of the connector 16 flush with the surrounding outer surfaces of the speaker enclosure 12 for good aesthetic appearance.

Figure 5:
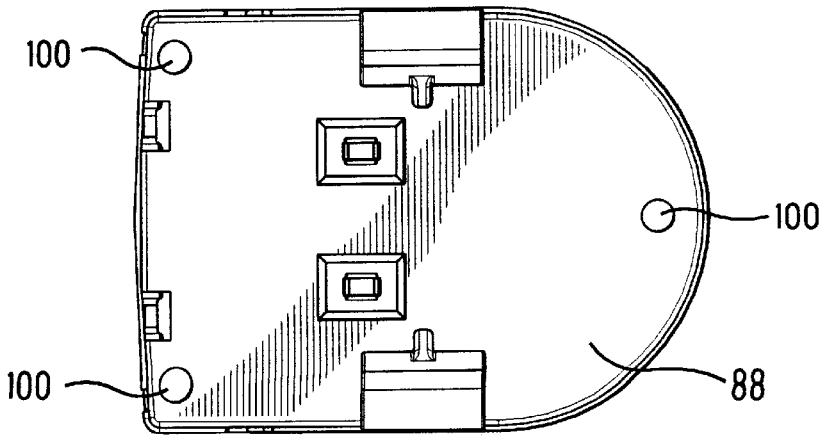
FIG. 5 is a bottom view of the connector shown in FIG. 2.
Figure 7:
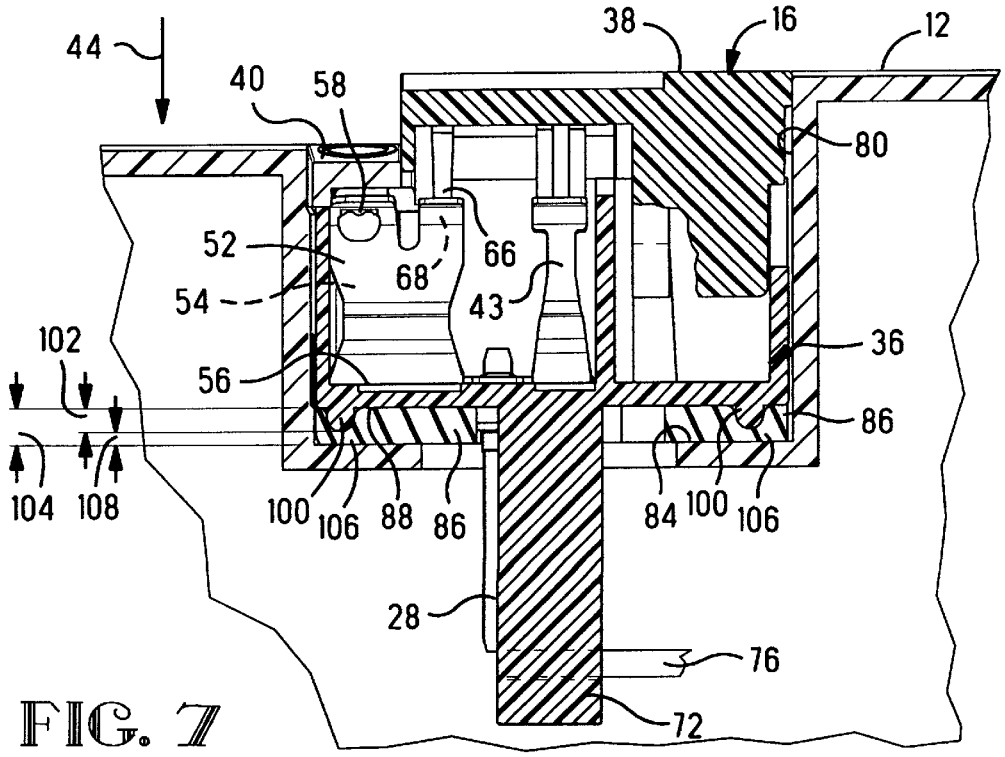

Three seating projections 100 extend from the bottom surface 88 of the housing 36, each having a spherical end. The projections 100 are spaced near the periphery of the bottom surface 88, as best seen in FIG. 5, so that they form the vertices of a triangle. Each projection 100 extends downwardly from the bottom surface 88 for a distance 102 of 0.030 inch, as shown in FIG. 7. When the connector 16 is properly latched in position within the cavity 80, as shown in FIG. 7, the gasket 86 is compressed to a thickness 104 equal to 0.040 inch. The portions 106 of the gasket 86 directly under the projections 100, are compressed further to a thickness 108 of 0.010 inch. When the push button 38 is depressed to the second position 46, the resilient member 43 is deflected to store energy to return the button to its first position when released. This deflecting of the resilient member, as the button is depressed, causes a force to transfer through the housing 36 to the floor 84 of the flange 82 through the gasket 86. This force tends to further compress the gasket 86 and, if the projections were not present, would, after a large number of compression and release cycles, cause the gasket to be crushed and thereby loose its resiliency. However, the projections prevent this from occurring by limiting the amount of further compression of the main part of the gasket to something less than 0.010 inch, at which point the portions 106 would have to be substantially completely penetrated by the projections. This, however, does not occur so there is always an amount of thickness 108 remaining when the push button is in its second position. Therefore, the thickness 104 of the main part of the gasket 86 will always be more that 0.030 inch which, in the present example, is sufficient to prevent damage to the gasket and permit it to remain sufficiently resilient to urge the connector housing 36 upwardly when the push button is released so that the latching members 72 are held firmly against the keeper surfaces 76. Additionally, the positioning of the three seating projections in a triangular pattern near the periphery of the connector housing serves to provide a tripod affect that stabilizes the connector when the push button is depressed thereby giving the connector a feel of firmness and quality.

While specific structures are disclosed herein, it will be understood by those skilled in the art, other suitable structures may be utilized in the practice of the present invention. For example a different number of seating projections may be advantagously utilized, or the connector housing, its contacts and latching members may be of a different structure.

An important advantage of the present invention is that the gasket 86 remains functional even after long usage and many compression and decompression cycles. Because the gasket is protected from over stressing it can be made somewhat thinner and therefore less expensively than thicker gaskets. Additionally, the tripod action of the three projections adds stability to the connector during use.

What is claimed is:

1. An electrical connector adapted to be resiliently secured to a first mounting surface of an electrical component for releasably receiving a conductor and electrically interconnecting said conductor to said component comprising:

(1) an insulating housing having a second mounting surface;

(2) an electrical contact in said housing interconnected to said component and operable to receive said conductor;

(3) a button in sliding engagement with said housing arranged so that when depressed in a first direction from an initial position toward said second mounting surface said contact operates to receive said conductor;

(4) a gasket disposed in engagement with said second mounting surface, and adapted to engage said first mounting surface and thereby be disposed between said first and second mounting surfaces; and (5) a spaced apart plurality of projections extending from said second mounting surface into pressing engagement with portions of said gasket, said gasket being continuous between said projections and said first mounting surface, thereby stabilizing said electrical connector when said connector is resiliently secured to said first mounting surface and said button is depressed in said first direction and preventing said gasket from being overcompressed as said button is moved in said first direction.

2. The connector according to claim 1 including a resilient means disposed between said housing and said button providing an upward force urging said button in a direction opposite said first direction so that when said button is depressed in said first direction said second mounting surface is urged against said gasket by a force at least as great as said upward force.

3. The connector according to claim 1 wherein said plurality of projections are three projections.

4. The connector according to claim 3 wherein said three projections are spaced apart so as to form the vertices of a triangle.

5. The connector according to claim 4 wherein said housing includes a pair of latch members adapted to extend into latching engagement with said component so that when said button is in said initial position said gasket is compressed to about 0.4 to about 0.6 of its free thickness, said gasket being further compressed where said projections engage said portions of said gasket.

6. The connector according to claim 5 wherein said projections extend from said second surface a distance that assures that said portions of said gasket extending between said projections and said first surface are compressed to about 0.10 times to not more than about 0.03 times of the free thickness of the gasket, when said button is depressed in said first direction, thereby preventing said gasket from being fully compressed and loosing its resiliency.

7. The connector according to claim 6 wherein each said projection includes a spherically shaped end in engagement with said gasket.

8. The connector according to claim 7 wherein said gasket is in sealing engagement with said first and second mounting surfaces thereby forming an acoustical seal between said connector and said component, when said connector is secured to said first mounting surface.

* * * * *